US009458677B2

(12) United States Patent
Struthers et al.

(10) Patent No.: US 9,458,677 B2
(45) Date of Patent: Oct. 4, 2016

(54) CABLE BYPASS AND METHOD FOR CONTROLLED ENTRY OF A TUBING STRING AND A CABLE ADJACENT THERETO

(71) Applicant: Schlumberger Technology Corporation, Houston, TX (US)

(72) Inventors: John David Struthers, Calgary (CA); George James Michaud, Calgary (CA); Lawrence Gerald Cyr, Red Deer (CA); Salem Ahmed Lotfi Elsayed, Hurghada (EG)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 379 days.

(21) Appl. No.: 13/915,734

(22) Filed: Jun. 12, 2013

(65) Prior Publication Data

US 2013/0292139 A1 Nov. 7, 2013

Related U.S. Application Data

(63) Continuation of application No. 12/842,095, filed on Jul. 23, 2010, now Pat. No. 8,573,294.

(60) Provisional application No. 61/230,197, filed on Jul. 31, 2009.

(51) Int. Cl.
*E21B 33/072* (2006.01)
*E21B 17/02* (2006.01)
(Continued)

(52) U.S. Cl.
CPC ..... *E21B 17/025* (2013.01); *E21B 17/023* (2013.01); *E21B 17/026* (2013.01); *E21B 33/03* (2013.01); *E21B 33/072* (2013.01); *E21B 33/0407* (2013.01); *E21B 33/085* (2013.01)

(58) Field of Classification Search
CPC .. E21B 17/025; E21B 33/0407; E21B 33/03; E21B 33/072; E21B 17/026
See application file for complete search history.

(56) References Cited

U.S. PATENT DOCUMENTS 2,154,955 A * 4/1939 Mueller ..... E21B 33/062 137/584
4,456,215 A 6/1984 Bishop et al.
(Continued)

FOREIGN PATENT DOCUMENTS

CN 1619905 A 5/2005
CN 1688788 A 10/2005
(Continued)

OTHER PUBLICATIONS

State Intellectual Property Office of the People's Republic of China, Search Report, Nov. 11, 2013, 1 Page, China.
(Continued)

*Primary Examiner* — Kipp Wallace
(74) *Attorney, Agent, or Firm* — David J. Smith

(57) ABSTRACT

A system and method is provided for the controlled entry of a tubing string, and cable adjacent thereto, into a wellbore. A stationary housing is fit to a wellhead and has a bore in communication with the wellbore. The cable can be laterally displaced from the bore into a cable access formed into the side wall of the stationary housing for fitting a sealing assembly to the bore and engages a sealing surface therein. The sealing assembly seals tubulars passing therethrough. The cable access interrupts the sealing surface. A cable bypass sub is fit to the cable access and permits the cable to extend sealingly from above the sealing surface to the wellbore wherein the cable bypasses the sealing assembly and sealing surface. A seal reconstitutes the interrupted portion of the sealing surface at the cable access.

7 Claims, 11 Drawing Sheets

(51) Int. Cl.

| | |
|---|---|
| ***E21B 33/03*** | (2006.01) |
| *E21B 33/04* | (2006.01) |
| *E21B 33/08* | (2006.01) |

(56) References Cited

U.S. PATENT DOCUMENTS

| | | | | |
|---|---|---|---|---|
| 4,506,729 | A * | 3/1985 | Davis et al. | 166/66.5 |
| 4,524,834 | A | 6/1985 | Barron et al. | |
| 4,660,635 | A * | 4/1987 | Wittrisch | 166/54.5 |
| 4,693,534 | A | 9/1987 | Clark | |
| 5,795,169 | A | 8/1998 | Reed | |
| 5,927,405 | A | 7/1999 | Monjure et al. | |
| 6,202,743 | B1 | 3/2001 | Moore | |
| 6,457,530 | B1 | 10/2002 | Lam et al. | |
| 6,688,386 | B2 | 2/2004 | Cornelssen et al. | |
| 6,851,478 | B2 * | 2/2005 | Cornelssen et al. | 166/368 |
| 6,871,708 | B2 * | 3/2005 | Calder et al. | 166/348 |
| 7,699,099 | B2 | 4/2010 | Bolding et al. | |
| 7,770,653 | B2 | 8/2010 | Hill et al. | |
| 8,074,722 | B2 * | 12/2011 | Murphy et al. | 166/379 |
| 8,196,649 | B2 | 6/2012 | Allen et al. | |
| 8,573,294 | B2 | 11/2013 | Struthers et al. | |
| 2003/0085040 | A1 * | 5/2003 | Hemphill et al. | 166/377 |
| 2004/0079532 | A1 | 4/2004 | Allen et al. | |
| 2007/0095528 | A1 * | 5/2007 | Ziauddin et al. | 166/252.3 |
| 2007/0193741 | A1 | 8/2007 | Smith | |
| 2007/0199718 | A1 * | 8/2007 | Boyd | 166/379 |
| 2009/0161997 | A1 | 6/2009 | Beauchamp et al. | |
| 2010/0038094 | A9 | 2/2010 | Webre et al. | |
| 2010/0294492 | A1 | 11/2010 | June et al. | |

FOREIGN PATENT DOCUMENTS

| | | | |
|---|---|---|---|
| EP | 0297899 | A1 | 1/1989 |
| RU | 82357069 | C1 | 5/2009 |
| SU | 1629470 | A1 | 2/1991 |
| WO | WO2010/144989 | A1 | 12/2010 |

OTHER PUBLICATIONS 201080043934.3, Struthers et al., Nov. 11, 2013.

Russian Decision on Grant for corresponding Russian Application Serial No. 2012107539 dated Sep. 4, 2014 (English Translation) 8 pages.

* cited by examiner

CABLE BYPASS AND METHOD FOR CONTROLLED ENTRY OF A TUBING STRING AND A CABLE ADJACENT THERETO

CROSS-REFERENCE TO RELATED APPLICATIONS

This application is a continuation of U.S. application Ser. No. 12/842,095 filed Jul. 7, 2010, which claims the benefit under 35 U.S.C. §119(e) of U.S. Provisional Application Ser. No. 61/230,197 filed on Jul. 31, 2009, which is incorporated fully herein by reference.

FIELD OF THE INVENTION

Embodiments of the invention relate to control devices for well operations and more particularly to a snubbing or rotating flow head having a wireline or cable side entry capability for operations requiring the controlled entry of a tubing string and an adjacent flexible conduit downhole.

BACKGROUND OF THE INVENTION

In the oil and gas industry it is conventional to directly or indirectly mount a flow head such as a rotating flow head on the top of a wellhead or a blowout preventer (BOP) stack. The rotating flow head, more commonly known as a rotating control device, serves multiple purposes including sealing off tubulars of a tubing string, moving in and out of a wellbore and accommodating rotation thereof. Tubulars can include a kelly, pipe or other drill string components. The rotating flowhead is an apparatus used for well operations and diverts fluids from the wellbore, such as drilling mud, surface injected air or gas and produced wellbore fluids, including hydrocarbons, into a recirculating or pressure recovery mud system.

Operations performed on a well that is not under pressure or flowing need not seal around tubing string as there is no risk of wellbore fluids exiting the wellbore under pressure. In such conditions, flexible conduit, such as a cable or wireline, is simply inserted downhole to provide an electrical connection between downhole logging tools and a surface unit. For wells that are under pressure, sealing around both the tubing string and cable is required. However, conventional sealing elements cannot seal around a tubular and a cable at the same time. Thus, necessitating the stoppage of flow of wellbore fluids and relief of wellbore pressures before further operations such as wireline operations can begin.

Often, underbalanced well operations require an additional flexible tubing or conduit, such as a wireline or cable, to be run downhole alongside a tubing string and connected to a downhole measurement tools. This requires sealing around the tubing string as well as the cable.

As standard rotating flow heads are not designed to seal around a tubing string and a cable running alongside the tubing string, wells under pressure, such as underbalanced wells, are therefore usually killed before operations commence. Killing wells introduces risk of damaging the well and/or reducing the capabilities for gathering data of the wells by logging tools.

Operations requiring the controlled entry of a flexible tubing string (ie. logging tools pushed down into a well on a drill string due to high angles of the well or wells under pressure), in order to avoid having to kill the well and risk damage thereto, require sealing around the tubular as well as sealing around the cable run alongside and adjacent a tubing string. Such operations enable downhole tools to be conveyed on the tubing string while also maintaining an electrical connection to a surface unit using a standard wireline cable.

One example of such an operation is the use of electrical submersible pumps (ESP) at a downhole end of a drill string. The ESP is run in the wellbore with a power cable running between the pump and the rig floor through the rotary table, adjacent or alongside the tubing string.

Another example can be operations involving the conveyance of downhole tools in a well using drill pipe tubulars until just above the bottom of the well. A cable side entry sub is then incorporated into the drill string, the cable side entry sub adapted to allow a cable to access the interior annular space of the drill string. The cable is rigged up at surface to the side entry sub for entering the inside or bore of the drill string. The cable is then run down inside the drill sting and further connects, via a wet connect, to the tools already downhole. The cable is tied up or fixed at the side entry sub and both the cable and drill string are simultaneously conveyed down to perform logging operations. The positioning of the side entry sub is such that it always stays inside the casing while the downhole tool may be within an uncased open hole.

A standard feature of a tough logging condition system (TLC) is that a certain length of cable, equal to the length of the logging interval at a minimum, ends up being outside that portion of the drill pipe located between the drill rig floor or wellhead and down to point in the drill string where the cable enters the drill pipe, i.e. the side entry sub.

In vertical wells, once underbalanced drilling is completed, the well can be logged using conventional logging techniques utilizing surface pressure control systems rigged up through the standard rig blow out prevention stack at the wellhead to accurately determine the reservoir productivity. Supply of $N_2$, if required, can be provided by a parasitic string inserted for this specific purpose.

However, in horizontal and high-angled wells, conventional TLC technique, as used in over-balanced drilling environment suffers, from a limitation as a certain cable section, equal in length to the interval being logged, must be kept outside of the drill pipe. The cable section is located between rig floor and the downhole cable side entry sub which cannot be sealed around as standard rotating flow heads are not designed to seal around a pipe with a wire outside it. Any attempt to do so, using conventional rotating flow heads, could damage the cable and jeopardize the whole operation. This means that advanced service logging operations such as high resolution imaging, production logging measurements, such as downhole flow rates, phase hold ups and zonal contributions from reservoir and others are not available using LWD or memory option, cannot be performed with a standard surface set up, which is a serious disadvantage for the exploration and production operator.

In some cases coil tubing with electric cable could be an option however the ability of coil tubing to push a heavy suite of open hole logging tools all the way to total depth in a long horizontal or high angled open hole is a shortcoming, as well as the added complexity, risk and investment needed to carry out such an operation.

There is a need for a system and a method to introduce a cable into a wellbore alongside a drill string and to seal the drill string and the cable during wellbore operations involving wells under pressure.

There is a need for a system and method to log a high-angled underbalanced well without killing the well.

There is a need for a system and method for sealing around a tubing string run downhole in a wellbore and cable run adjacent the tubing string in the wellbore.

SUMMARY OF THE INVENTION

An apparatus and a method are disclosed for accessing an underbalanced well with a tubing string and a flexible conduit, such as a cable or wireline. The apparatus can be applied for rotating flow heads or flow heads adapted for snubbing operations in which no rotation of tubing string tubulars is necessary. Herein a rotating flow head is also intended generally to apply to a flow head that may not necessarily accommodate rotation as set forth in the description below.

An embodiment of the invention comprises passing a tubing string and cable or wireline sealably and therefore safely into a wellbore. A stationary body or housing of a flow head is installed on top of a wellhead. Typically a BOP is located therebelow for temporarily isolating the flow head from pressurized well conditions as necessary. A wireline is rigged up to a side entry sub of the tubing string. The tubing string and wireline is safely inserted through a bore of the stationary housing and through the wellhead.

In a broad aspect of the invention, a system for sealing around a tubing string run downhole in a wellbore and a cable run adjacent the tubing string in the wellbore is disclosed. The system has a stationary housing having a bore with an upper portion, a lower portion in fluid communication with the wellbore and a sealing surface therebetween. The stationary housing has a side wall having a cable access extending from the upper portion of the bore to the lower portion of the bore for receiving the cable when the cable is laterally displaced away from the bore. The sealing surface is interrupted by the cable access.

The system further has a sealing assembly for sealing around the tubing string, and a cable bypass sub for passage of the cable therethrough.

The cable is laterally displaced into the cable access permitting the sealing assembly to be fit to the upper portion of the bore and sealingly engage the sealing surface. The cable bypass sub is fit to the cable access for reconstituting the interrupted portion of the sealing surface and permitting the cable to bypass the sealing assembly.

In another aspect of the invention, a method for sealing around a tubing string run downhole in a wellbore and a cable run adjacent the tubing string in the wellbore is disclosed. The method involves the steps of 1) providing a stationary housing having a bore with an upper portion, a lower portion in fluid communication with the wellbore, and a sealing surface therebetween, 2) passing the tubing string through a sealing assembly, 3) passing the cable through a cable bypass sub for establishing a wellbore portion for running in the wellbore, 4) isolating the wellbore, 5) inserting the tubing string and sealing assembly and the wellbore portion of the cable through the bore of the stationary housing, 6) laterally displacing the cable from the bore into a cable access formed in a side wall of the stationary housing, the cable extending from the upper portion of the bore to the lower portion of the bore, 6) fitting the sealing assembly to the sealing surface of the bore with the cable bypassing the sealing assembly in the cable access, 7) sealing the sealing surface by fitting the cable bypass sub to the cable access, 8) sealing around the cable; and 9) opening the wellbore to the lower portion of the stationary housing.

For use in large or big bore installations, the wireline running alongside the tubing string need not encroach on the structure of the stationary housing as described. Thus in another broad aspect of the invention, a system for sealing around a tubing string run downhole in a large wellbore and a cable run adjacent the tubing string in the large wellbore is disclosed. The system has a stationary housing having a bore with an upper portion, a lower portion in fluid communication with the wellbore and a sealing surface therebetween. A sealing assembly is fit to the upper portion of the bore for sealing around the tubing string and has a cable access for passage of the cable therethrough.

Herein, wireline, cable and other flexible conduit are used interchangeably.

DETAILED DESCRIPTION OF THE PREFERRED EMBODIMENTS

Figures 1A, 1B, 1C, 1D:
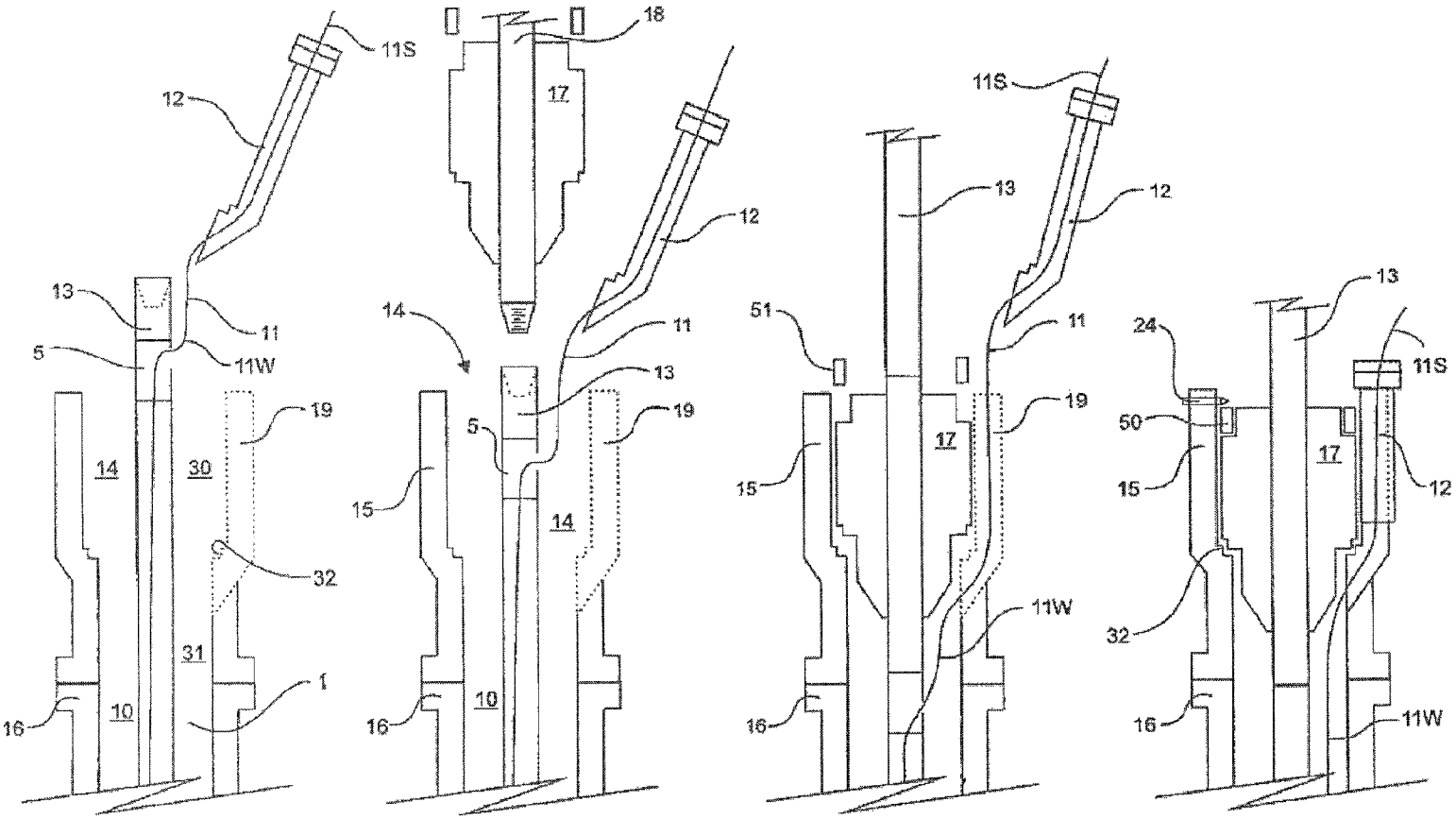
FIG. 1A is a schematic diagram of a method of this present invention, illustrating the stripping of a cable or wireline a cable bypass sub of this present invention.
FIG. 1B is a schematic diagram of a method of this present invention, illustrating the insertion of the drill string and wireline of FIG. 1A into a bore of a stationary housing and the installation of a sealing assembly about a portion of a drill string outside the well.
FIG. 1C is a schematic diagram of a method of this present invention, illustrating the repositioning of the cable of FIGS. 1A and 1B from within the bore to a cable access in the stationary housing, and the insertion of the sealing assembly within the bore of the stationary housing.
FIG. 1D is a schematic diagram, according to FIGS. 1A-1C, illustrating the securing of the sealing assembly within the bore of the stationary housing, the securing of the cable bypass sub and the controlled entry of the drill string with the cable adjacent alongside the drill string.

A system is disclosed for allowing controlled entry of a tubing string and a flexible conduit, such as a wireline or cable adjacent the tubing string, through a wellhead into a wellbore under pressure. Hereinafter, the flexible conduit is referred to as a cable. The system seals the wellbore from the environment above the wellhead passage of a tubing string and a cable through the wellhead. Such wellbores can include high-angled underbalanced wellbores.

Conventional Wellbores

FIGS. 1A, 1B, 1C and 1D illustrate an embodiment of a methodology for controlled entry of a tubing string 13 and a cable 11 into a wellbore 1. The system is adapted for use with a wellhead 16 which can include a BOP stack for conventional safe operation above an unbalanced or pressurized wellbore 1. A stationary housing 15 is connected to the wellhead 16 with a bore 14 in fluid communication with the wellbore 1. Both the tubing string 13 and the cable 11 need to pass through the bore 14 and effect a separation of the wellbore 1 from the environment. A sealing assembly 17 cooperates with the stationary housing 15 for sealing about tubing string 13 and sealing the wellbore 1 below the sealing assembly 17. A cable bypass sub 12 cooperates with the stationary housing 15 and sealing assembly 17 for bypassing the cable 11 about the sealing assembly 17 without losing wellbore 1 integrity around the sealing assembly 17. Thus, both the tubing string 13 and cable 11 can enter the wellbore 1 in a controlled manner.

FIG. 1A illustrates the cable 11 passing through or stripped through the cable bypass sub 12. A wellbore portion 11W of the cable 11 extends below the cable bypass sub 12. A surface portion 11S of the cable 11 remains above the cable bypass sub 12. In this embodiment, the cable wellbore portion 11W is, or has been, installed to extend into the interior annular space of tubing string 13 through a tubing side entry sub 5 such as that commonly used in the industry. The cable wellbore portion 11W and tubing string 13 are positioned or received in the bore 14 of the stationary housing 15.

FIG. 1B illustrates the tubing string 13 and cable wellbore portion 11W being lowered through the bore 14 of the stationary housing 15. The cable wellbore portion 11W runs adjacent the tubing string 13 below the sealing assembly 17. Additional or subsequent tubulars 18 of the tubing string 13 are sequentially added to enable lowering of the tubing string 13 and adjacent cable 11 into the wellbore 1. The sealing assembly 17 is fit about a subsequent tubular which is then connected or threaded to a previous tubular of the tubing string 13 extending downhole.

FIG. 1C illustrates a lateral displacement of the cable wellbore portion 11W from within the bore 14 of the stationary housing 15 to a position within a cable access 19 formed in the side wall 34 of the stationary housing 15. Lateral displacement of the cable wellbore portion 11W clears the bore 14 for fitment of the sealing assembly 17 therein. The sealing assembly 17 is lowered into the bore 14 for engagement of a supporting and sealing surface 32 of the stationary housing 15. As the cable access 19 interrupts the sealing surface, means are installed, such as that associated with the cable bypass sub 12, to reconstitute the sealing surface so as to seal the sealing assembly 17 to the bore 14, thus effecting isolation of the wellbore 1. The cable bypass sub 12 is secured to the stationary housing 15.

As shown in FIG. 1D, the sealing assembly 17 is secured within the bore 14 of the stationary housing 15, such as with holddown or a plurality of lag bolts 24 engaging the top of other sealing assembly 17 or intermediate ring 51. The cable 11 is sealed within the cable side entry sub or some other cable seal thereabove for completing the isolation of the wellbore 1 from above the sealing surface. Thereafter, controlled entry of the tubing string 13 and the cable 11 commences.

Referring FIGS. 2 through 7, 8A and 8B, embodiments of the components of a system 10 are detailed which enable controlled entry of a tubing string 13 and cable 11 into a wellbore 1.

Figure 2:
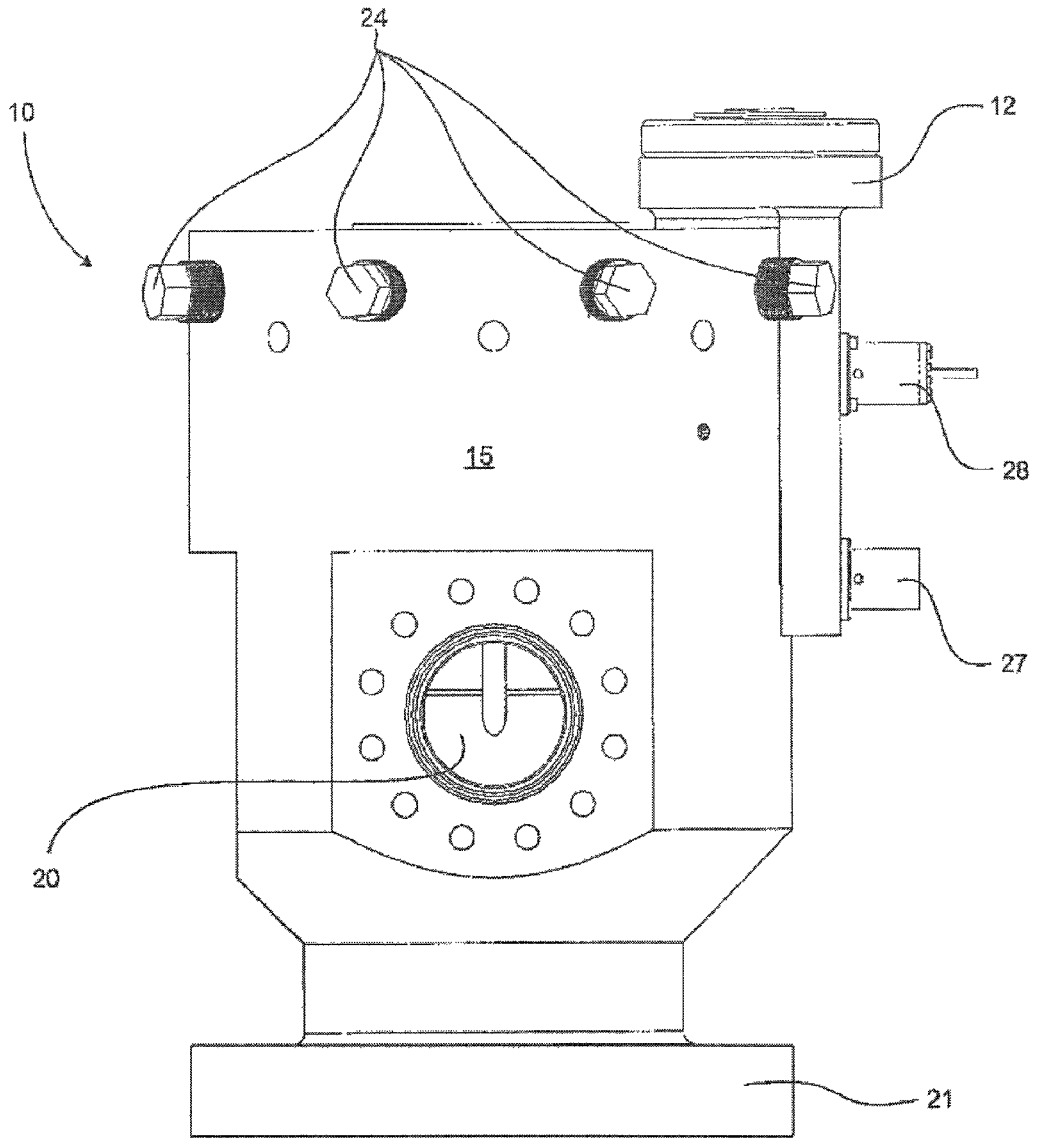
FIG. 2 is a side view of an embodiment of the present invention, illustrating a cable bypass sub operatively attached and secured to a stationary housing of a rotating flow head.

Referring to FIG. 2, the system 10 comprises the stationary housing 15 as part of a rotating flow head adapted to fluidly connect to the wellhead 16. The stationary housing 15 further comprises a cable bypass sub 12 for bypass passage of the cable 11 therethrough. The stationary housing 15 can comprise one or more side ports 20 for redirecting wellbore fluids to a pressure recovery mud system or mud tank (not shown), and a lower flange 21 for operatively connecting above a BOP stack of the wellhead 16.

Figure 3:
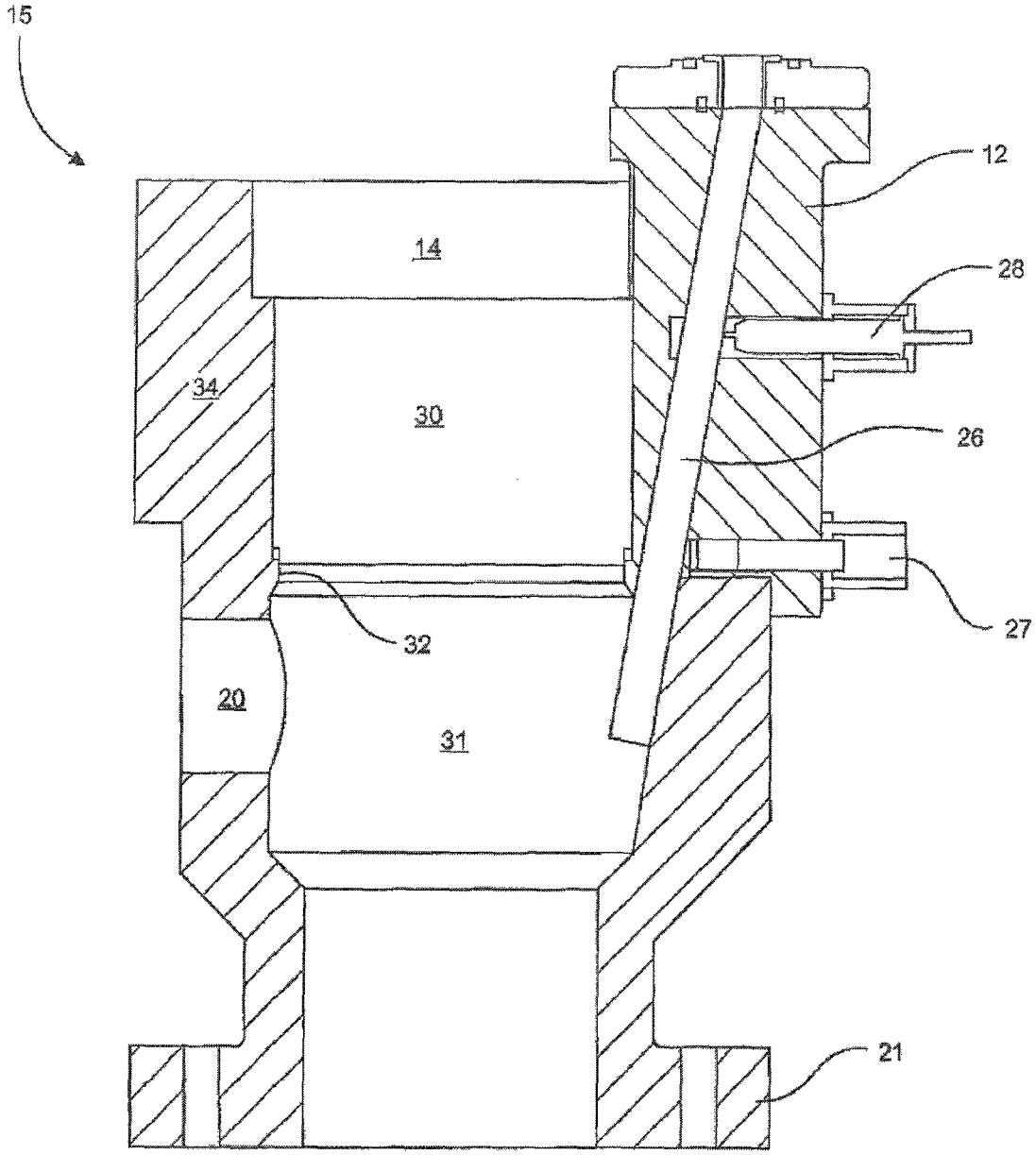
FIG. 3 is a side cross-sectional view of an embodiment of the present invention according to FIG. 2, the cross section being through the stationary housing and through the cable bypass sub illustrating the stationary housing without the sealing assembly.
Figure 4:
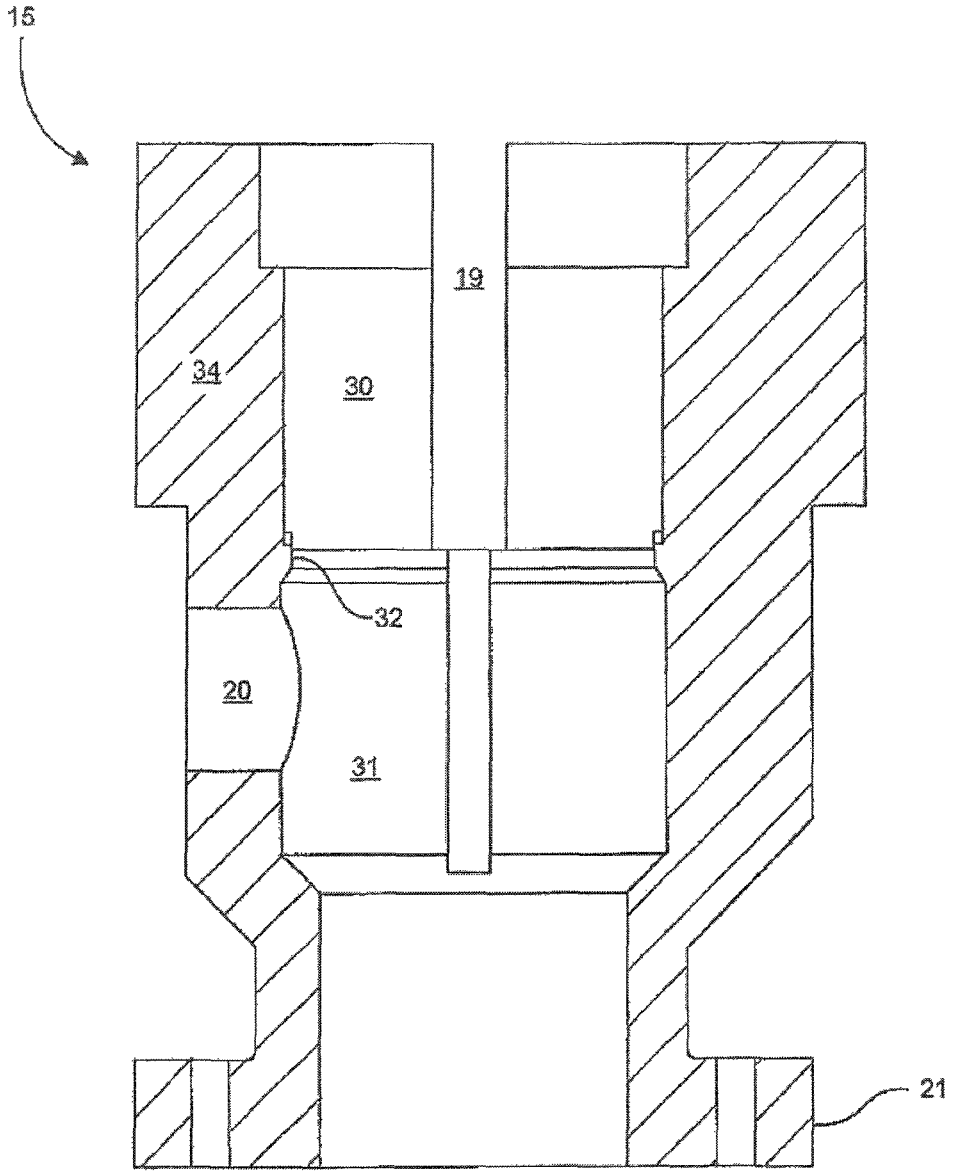
FIG. 4 is a rotated cross-sectional view of the stationary housing of FIG. 3, for facing and illustrating the cable access.

Referring to FIGS. 3 and 4, the bore 14 of the stationary housing 15 has an upper portion 30 for receiving the sealing assembly 17, a lower portion 31 for fluidly connecting to the wellbore 1, and a sealing surface 32 therebetween.

Referring to FIG. 4, a rotated cross-sectional view of the stationary housing 15 is shown with the cable bypass sub 12 removed for illustrating the side wall 34 having the cable access 19 cut through therethrough.

The cable access 19 extends from the upper portion 30 of the bore 14 to the lower portion 31 of the bore 14, interrupting a portion of the sealing surface 32 for receiving the cable 11 laterally displaced from the bore 14. The cable access 19 and the cable bypass sub 12 are matched for coupling and forming the structurally integrated stationary housing 15. As shown in FIG. 4, the cable access 19 is shown as formed entirely through the side wall 34. Depending upon the characteristics of the side wall, the cable access 19 may be also be a recess (not shown) similar to a keyway in which case the corresponding cables side entry sub would be insertable axially along such as recess.

Figure 5:
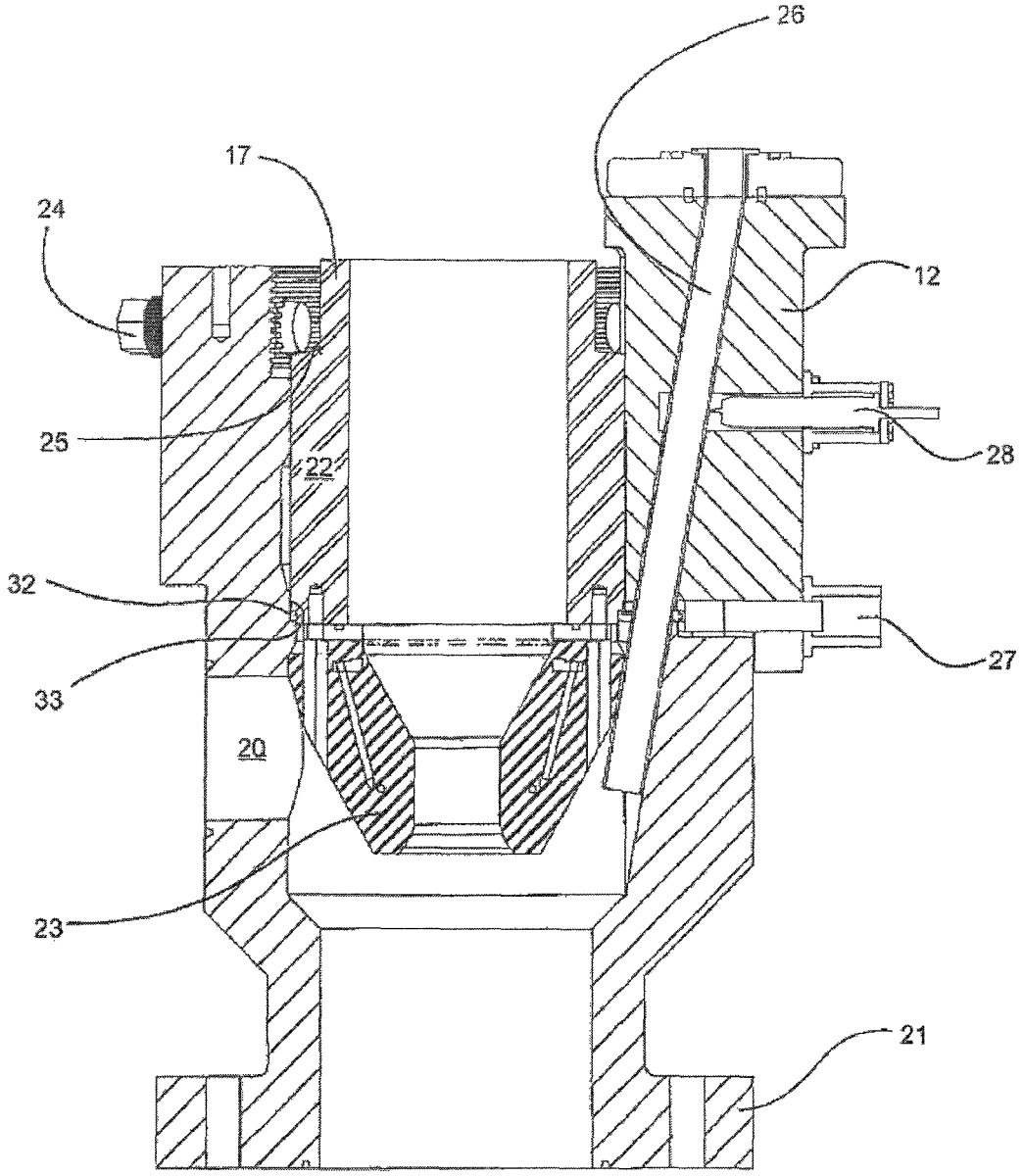
FIG. 5 is a side cross-sectional view of an embodiment of the present invention according to FIG. 2, illustrating a stationary housing, a cable bypass sub, and a sealing assembly.

As shown in FIG. 5, the sealing assembly 17 is fit within the bore 14 of the stationary housing 15. A support shoulder 33 of the sealing assembly 17 engages the sealing surface 32 for isolating the wellbore 1 below the sealing assembly 17 and preventing against uphole movement of wellbore fluids and aiding in the redirection of the wellbore fluids through the plurality of side ports 20. The sealing assembly 17 is held down and secured within the upper portion 30 of the bore 14 by the plurality of lag bolts 24 circumferentially spaced about a top portion of the stationary housing 15. The plurality of lag bolts 24 are radially actuable, extending into and encroaching on the bore 14 to secure the sealing assembly 17 and retracting from the bore 14 to enable fitment and release of the sealing assembly 17 from the bore 14. The circumferentially spaced lag bolts 24 provide sufficient angular space in the side wall 34 therebetween to allow the cable access 19 to encroach the stationary housing 15 and be cut through the side wall 34.

Typical methods commonly used in the industry today for securing the sealing assembly 17 within the stationary housing 15 of a conventional rotary control head involve placement of a cap or ring over the entire sealing assembly 17 and stationary housing 15. This ring is then securely held and urged to apply a downward force on the sealing assembly by a hydraulically actuated clamp that circumferentially engages the ring and a top portion of the stationary housing. Although the employment of the clamp and ring method to secure the sealing assembly 17 within the stationary housing 15 could permit the cable access 19 of the present invention to encroach a side wall of the stationary housing 15, the clamp and ring would appear to interfere with the lateral displacement of the cable 11 from within the bore 14 of the stationary housing 15. The inability of the clamp and ring method for allowing the lateral displacement of the cable 11 from the bore 14 is a limitation that is overcome by the lag bolts 24 of the present invention.

The lag bolts 24, when actuated to secure the sealing assembly 17, apply a downward force thereto. As shown in FIGS. 1B, 1C and 1D, the lag bolts 24 can engage an upper shoulder 25 of the sealing assembly 17 or an intermediate ring 51. The intermediate ring 51 is an annular ring which is fit to the upper portion 30 of the bore 14 above the sealing assembly 17. The lag bolts 24 engage the intermediate ring 51 which secures the sealing assembly 17 to the bore 14. Actuation of the lag bolts 24 may be automated or manual.

Figure 6:
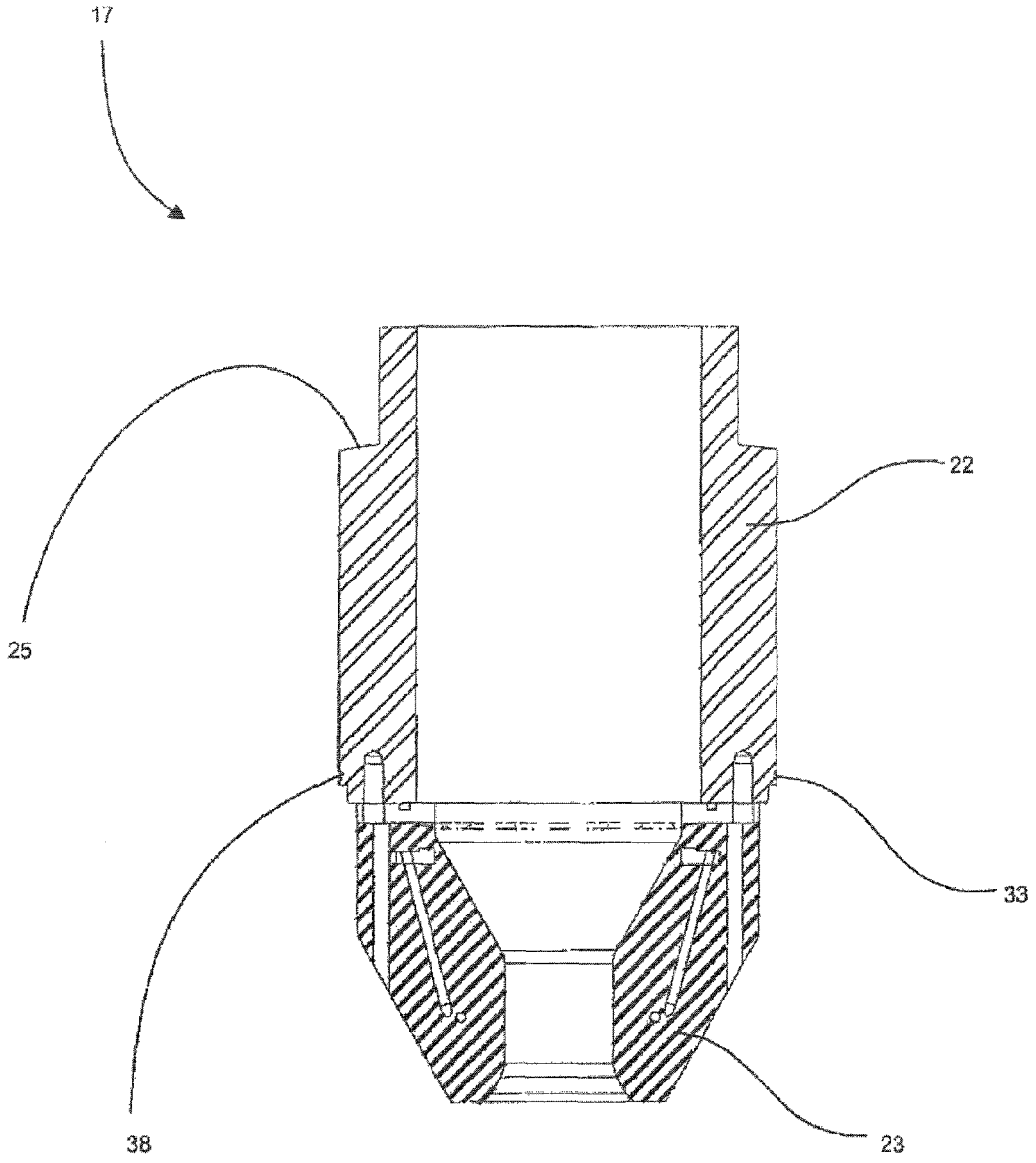
FIG. 6 is a side view of an embodiment illustrating a sealing assembly.

Illustrated in FIGS. 5 and 6, the sealing assembly 17 comprises a cylindrical sleeve 22 having an elastomeric rubber stripper element 23 at a lower end. The cylindrical sleeve 22 is adapted to pass the tubulars 18, such as a kelly, a pipe or other drill string components therethrough while the elastomeric stripper element 23 seals around the tubulars 18. The cylindrical sleeve 22 forms the upper shoulder 25 for engagement with the lag bolts 24 to secure the sealing assembly 17 within the upper portion 30 of the bore 14. The cylindrical sleeve 22 further comprises the support shoulder 33 having a surface 38 that sealingly engages the sealing surface 32.

Figure 7:
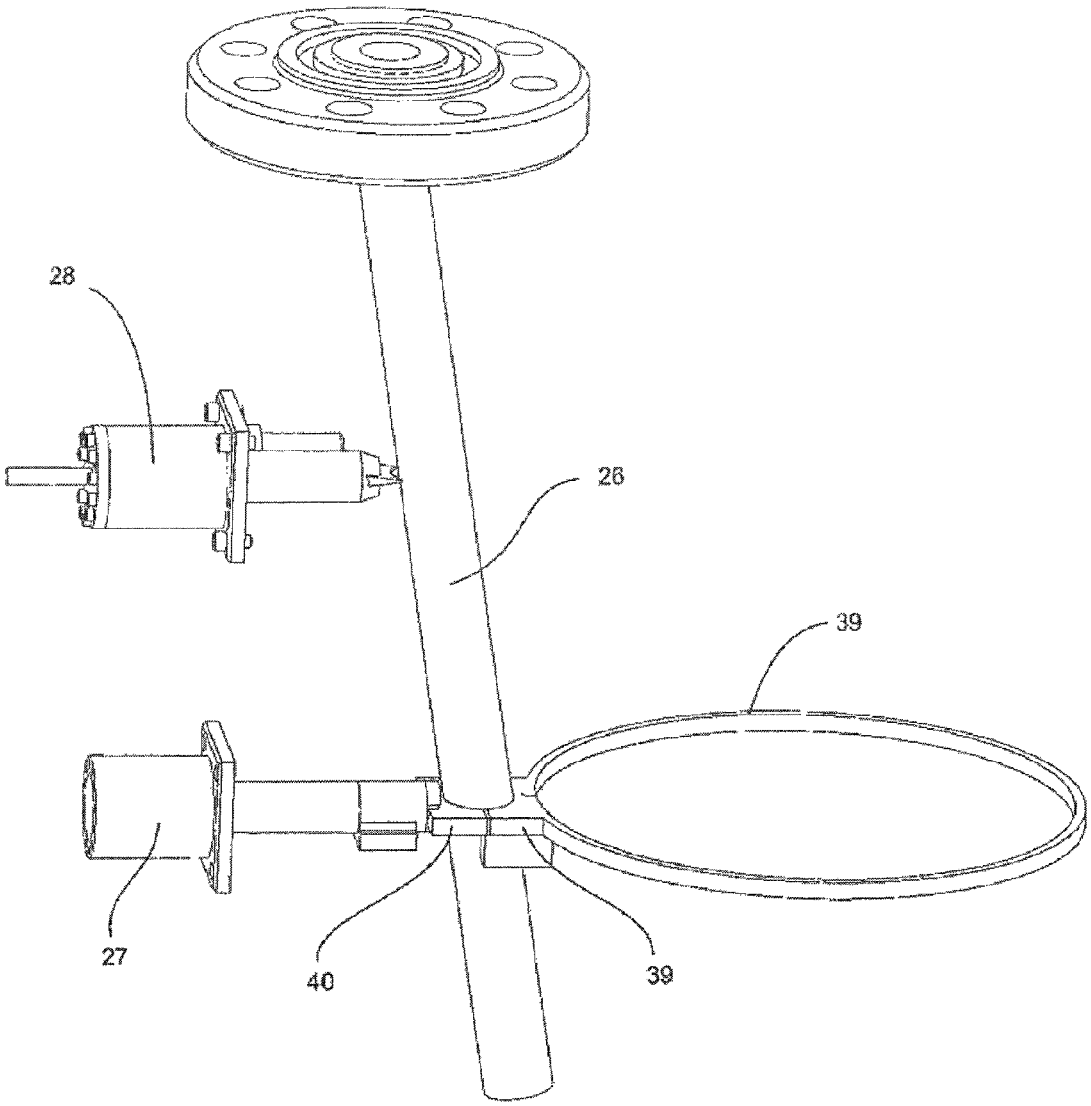
FIG. 7 is a partial perspective view of the cable bore isolated from the cable bypass sub for illustrating the relationship of the cable shear ram, the cable sealing ram and the O-ring for the sealing surface.

The surface 38 of the shoulder 33 can comprise a plurality of circumferential grooves adapted to fit sealing elements. Referring to FIG. 7, such sealing elements can include an O-ring 39 to prevent passage of wellbore fluids between the sealing assembly 17 and the side wall 34 of the stationary housing 15. The O-ring 39 can include a U-shaped protraction to wrap partially about the cable bypass sub 12 or the structure about a cable bore 26.

The elastomeric rubber stripper element 23 has an inner diameter that is normally smaller than the outer diameter of the tubing string 13 that is fit within the cylindrical sleeve 22. As a result, the elastomeric rubber stripper element 23 creates a positive or passive seal around tubulars 18, preventing upward movement of wellbore fluids through the sealing assembly 17 and the stationary housing 15.

Referring to FIGS. 5 and 7, the cable bypass sub 12 allows the cable (omitted) to pass through the cable bore 26 and bypass the sealing assembly 17 when fit in the upper portion 30 of the bore 14, the cable bore extending from the upper portion 30 above the sealing surface 32 to a lower portion 31 of the bore 14. The cable bypass sub 12 comprises the cable bore 26 and a reconstituting seal 40, such as that actuated by a sealing ram 27, for reconstituting the interrupted sealing surface 32 between the stationary housing 15 and the cable bypass sub 12. The cable bore 26 extends downhole and enters the lower portion 31 of the bore 14 below the sealing assembly 17. The orientation of the cable bore 26 ensures that the cable entering the lower portion 31 of the bore 14 does not contact the stripper element 23 or a downhole portion of the sealing assembly 17 for reducing risk to the cable and sealing assembly. The cable bore 26, as shown in FIG. 5, can extend below the stripper element 23 to prevent contact of the cable and the stripper element 23.

In an alternate embodiment, the cable bore 26 can have a seal or cap device such as a debris seal for minimizing entry of drill cuttings, and other debris from the wellbore, into the cable bore 26.

A portion of the sealing surface 32 of the bore 14 is interrupted due to the cable access 19 extending through the side wall 34 of the stationary housing 15. As a result of the interruption of the sealing surface 32, installation of the cable bypass sub 12 may not necessarily ensure complete sealing engagement between the shoulder 33 of the sealing assembly 17, and the sealing surface 32 of the bore 14.

Referring to FIG. 7, to maintain a complete sealing engagement between the sealing assembly 17 and the sealing surface 32 of the bore 14, the interrupted portion of the sealing surface 32 is reconstituted. A reconstituting seal 40 is provided, integral with the cable bypass sub 12, or via independent sealing means. As shown, the cable bypass sub 12 incorporates a method to reconstitute or recuperate the interrupted portion of the sealing surface 32 including the use of a reconstituting seal 40 actuated by the sealing ram 27. The sealing ram 27 can be actuated to forcibly insert a seal, such as a U-shaped seal 40 to cooperate with the form fit to the structure of the cable bore 26. More particularly the sealing ram 27 can force the U-shaped reconstituting seal 40 to cooperate with the cable bore 26 and O-ring 39 of the sealing surface 32 and seal entirely about the cable bypass sub 12. In this embodiment, reconstituting seal 40 is fit about the cylindrical structure of the cable bore 26 for reconstituting the interrupted portion of the sealing surface 32. The cable 11 passes through the cable bore 26 to enter the lower portion 31 of the bore 14 below the stripper element 23 of the sealing assembly 17.

Also shown in FIGS. 5 and 7, and in another embodiment, the cable bypass sub 12 can also include one or more cable shear rams 28 for emergency shearing of the cable 11. In an alternate embodiment, the cable bypass sub 12 can further comprise a high pressure seal to seal around the cable for isolating the wellbore below the sealing assembly.

Figure 8A:
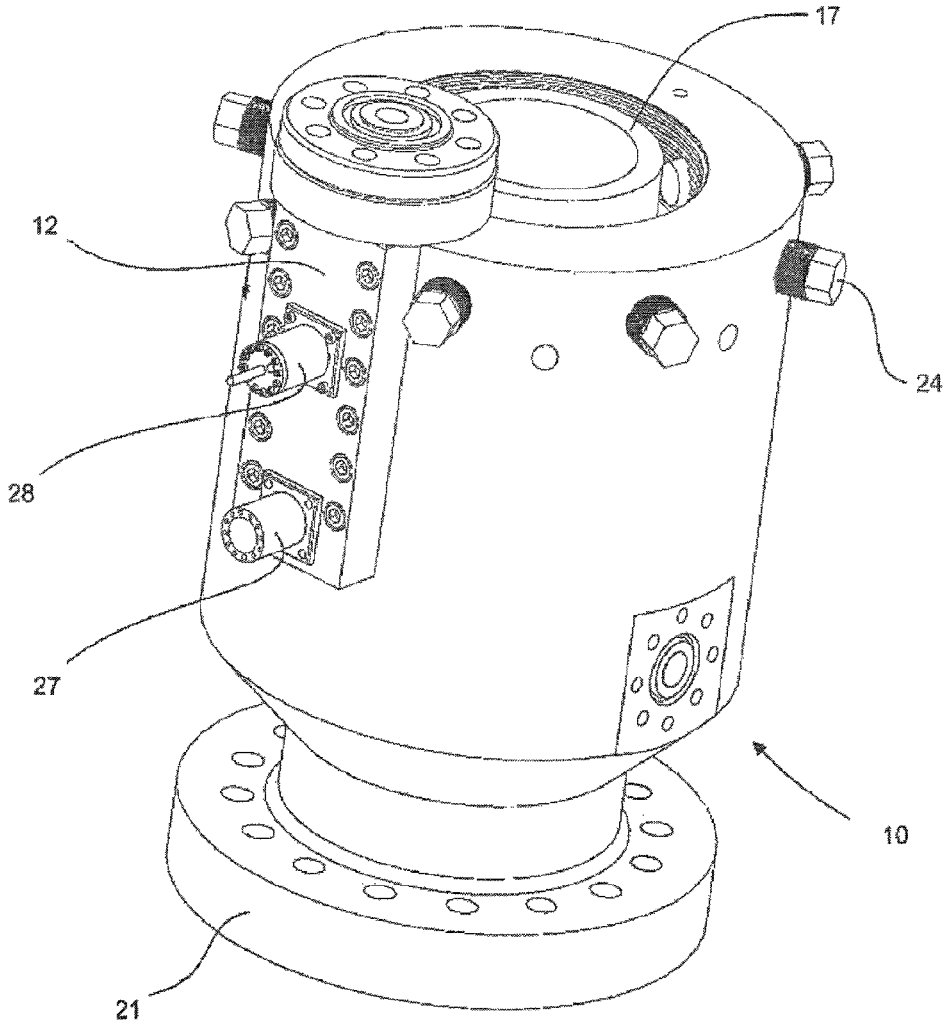
FIGS. 8A and 8B are perspective views according to FIG. 2, showing the cable bypass sub fit to the stationary housing, and the cable bypass sub shown exploded from the stationary housing to which it is secured to complete the structural integrity of the stationary housing.
Figure 8B:
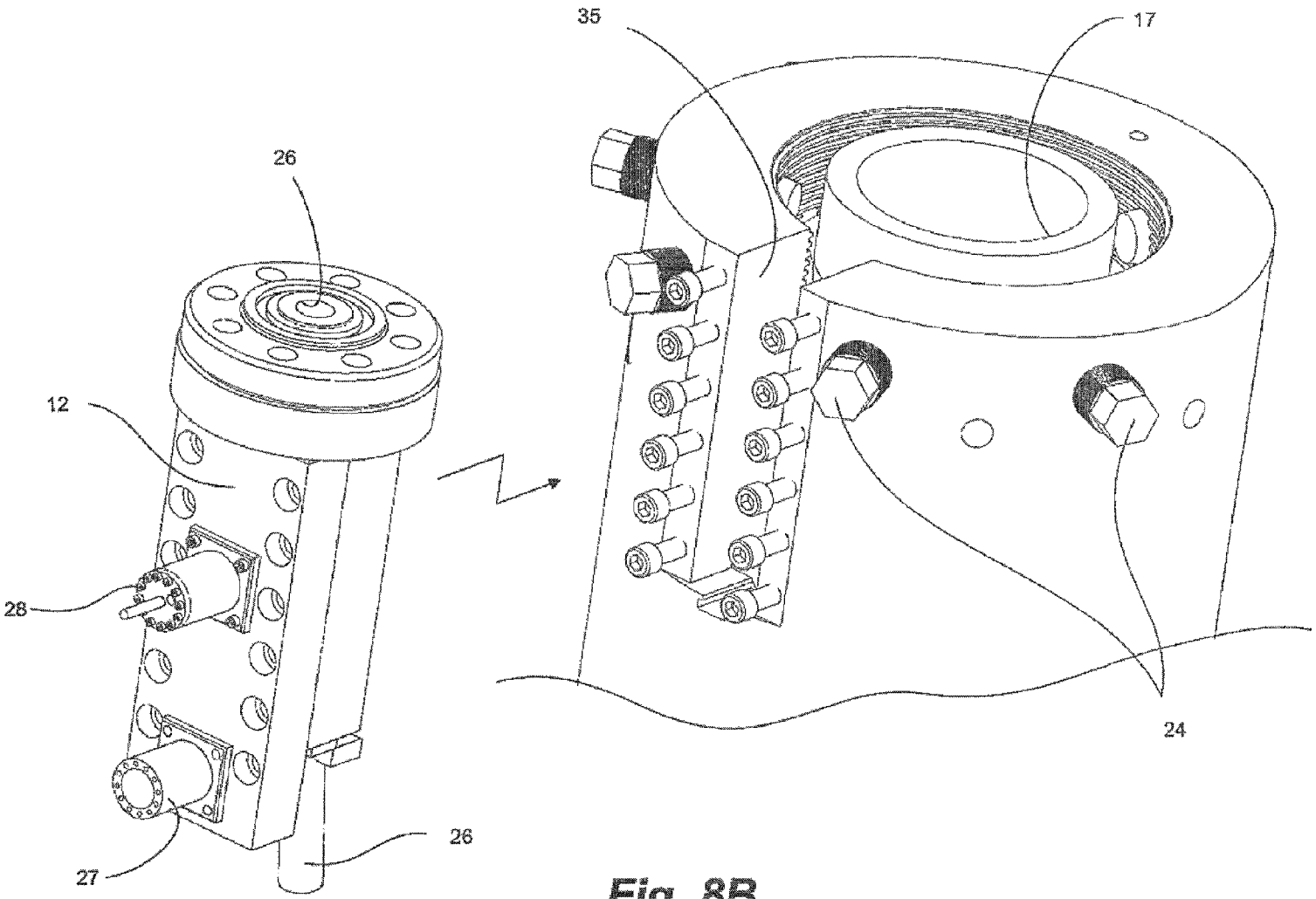

Referring to FIGS. 8A and 8B, the cable access 19 disrupts the sealing surface 32, and in instances where the cable access 19 extends significantly or entirely through the side wall 34, the structural integrity of the stationary housing 15 is compromised. Accordingly, the cable bypass sub 12 and stationary housing 15 are fit with compatible mounting and securing surfaces which complete the stationary housing 15 when installed and return the stationary housing 15 to its original structural capability. As shown, a substantial cable bypass sub 12 is secured with cap screws to straddle the cable access 19.

In Operation

Figure 9:
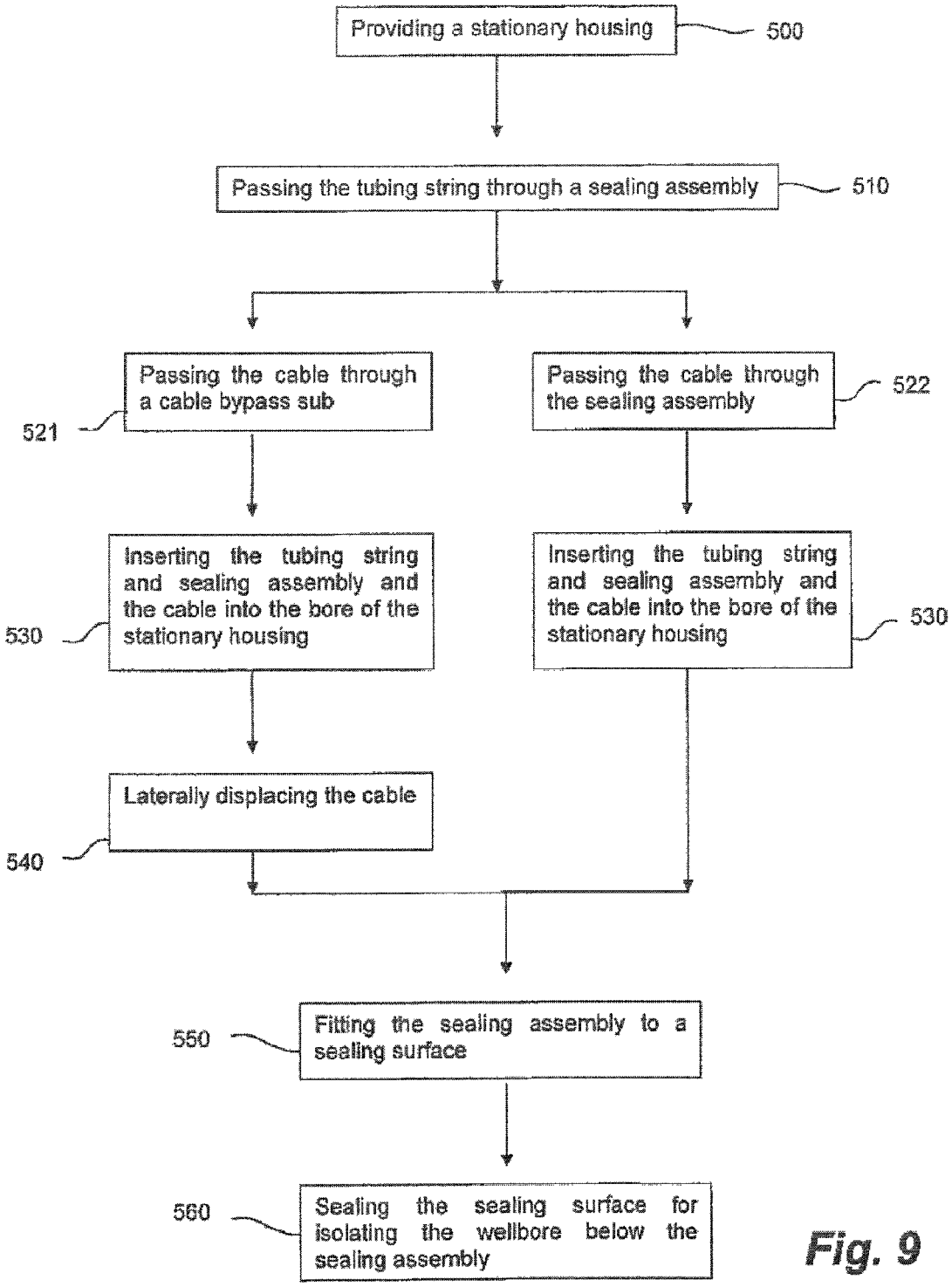
FIG. 9 is a flow chart comparing the methodologies of running a tubing string and a cable adjacent the tubing string downhole in a conventional wellbore versus a larger wellbore.

Referring to the stages illustrated in FIGS. 1A, 1B, 1C and 1D, and the flow chart of FIG. 9, at a first block 500, a method is set forth for running the tubing string 13 and the cable 11 adjacent the tubing string 13 downhole. The stationary housing 15 is provided in fluid communication with the wellbore 1. The stationary housing 15 can be a structure for a rotating control head having the bore 14 with the upper portion 30, the lower portion 31 in fluid communication with the wellbore 1. The sealing surface 32 is formed between the upper portion 30 and the lower portion 31 which cooperates with the sealing assembly 17. In one embodiment, the stationary housing 15 is provided upon completion of normal drilling operations. In such a case, the drill string or tubing string 13 is tripped out of the wellbore 1 and the wellbore 1 is isolated at the surface. At block 510 the tubing string 13 is passed through the sealing assembly 17 of this present invention, for sealing therearound.

Referring to FIG. 1A and at block 521 of FIG. 9, for enabling additional operations, the cable 11 is then passed through the cable bypass sub 12, establishing the cable wellbore portion 11W for running in the wellbore 1. The cable wellbore portion 11W is typically inserted into the annulus of the tubing string 13 through a side entry sub 5 as commonly performed in normal wireline operations. The cable 11 is typically run downhole to latch and wet connect to logging tools already downhole. The side entry sub 5 forms part of the tubing string 13. The cable wellbore portion 11W is now running adjacent the tubing string 13 and is not conventionally sealable in the stationary housing 15.

Referring to FIG. 1B and at block 530 of FIG. 9, a subsequent length of tubing 18 is passed through the sealing assembly 17 and made up to the tubing string 13. The tubing string 13 and sealing assembly 17 and the cable wellbore portion 11W is then inserted into the bore 14 of the stationary housing 15.

Referring to FIG. 1C and at block 540 of FIG. 9, the cable 11 is laterally displaced from the bore 14 into the cable access 19 in a side wall 34 of the stationary housing 15 for clearing the bore 14 for fitment of the sealing assembly 17 therein. The cable 11 bypassing the sealing assembly 17 with the cable wellbore portion 11W extending downhole into the wellbore 1. The cable 11 extends from the upper portion 30 to the lower portion 31 of the bore 14 through the cable access 19.

Referring to FIG. 1C and at block 550 of FIG. 9, the sealing assembly 17 is fit to the sealing surface of the bore 14, and the cable bypass sub 12 is fit within the cable access 19.

At block 560 the sealing surface 32 is sealed at the cable access 19 for isolating the wellbore 1 below the sealing assembly 17. The cable bypass sub 12 is secured to the stationary housing, which in one embodiment, completes a seal around the sealing assembly 17 using the reconstituting seal 40. The sealing assembly seals the tubing string 13. A seal is effected about the cable 11. The wellbore 1 can be opened to the lower portion 31 of the stationary housing 15 for controlled running of the tubing string 13 and sealed cable 11 downhole, such as for logging operations.

A person or ordinary skill in the art would understand that if the cable bypass sub 12 itself is not equipped to seal around the cable 11 passing through therein, some other sealing device, such as a cable lubricator, stuffing box, grease injector control unit, or the like, can be integrated to operatively attached uphole of the cable bypass sub 12.

Large or Big Bore Wellbores

For operations involving large or big bore wellbores, a big bore embodiment of the present invention can be used. The big bore system will have the capability to run a cable therethrough from the top of a stationary housing instead of from the side of the stationary housing as in case of the system for conventional bores. The cable can enter through a cable entry 41, such as a flanged port, positioned along a top of the sealing assembly 17 and adjacent to a bearing cap. The cable can pass through the cable bore 26 and exit the sealing assembly 17 adjacent the stripper element 23. The surface portion 11S of the cable can be run adjacent a dual barrier, if installed on top of the bearing cap.

The sealing assembly 17, in one embodiment, can replace a conventional bearing assembly for this operation, although the conventional bearing assembly can be maintained if rotation is required. The big bore system can comprise the stationary housing 15 for accepting the sealing assembly 17. The sealing assembly 17, allowing a tubing string to pass therethrough, has the stripper element 23 at its bottom to seal around the tubing string. The sealing assembly can further have an element at its top to allow a dual barrier. The cable bore 26 can be built into the sealing assembly 17 to allow the cable to pass therethrough and exit the sealing assembly 17 adjacent the stripper element 23.

The cable bore 26 can extend below the cylindrical sleeve 22 to terminate adjacent to the stripper element 23, allowing the cable wellbore portion 11W to pass and enter the lower portion 31 of the bore 14 without getting pinched between stripper element 23 and the stationary housing 15 when tubing string having tool joints pass through the stripper element.

The cable entry 41 for the cable bore 26 can be fluidly connected to a stuffing box, a cable lubricator, a grease injector control unit or the like to provide a pressurized seal for the cable. In one embodiment, the stuffing box or other pressurized sealing device can be fluidly connected directly to the cable bore 26 without the use of a flanged connection such as the cable entry 41. In such cases, as in the use of a stuffing box, grease can be pumped to maintain the pressurized seal.

Figure 10:
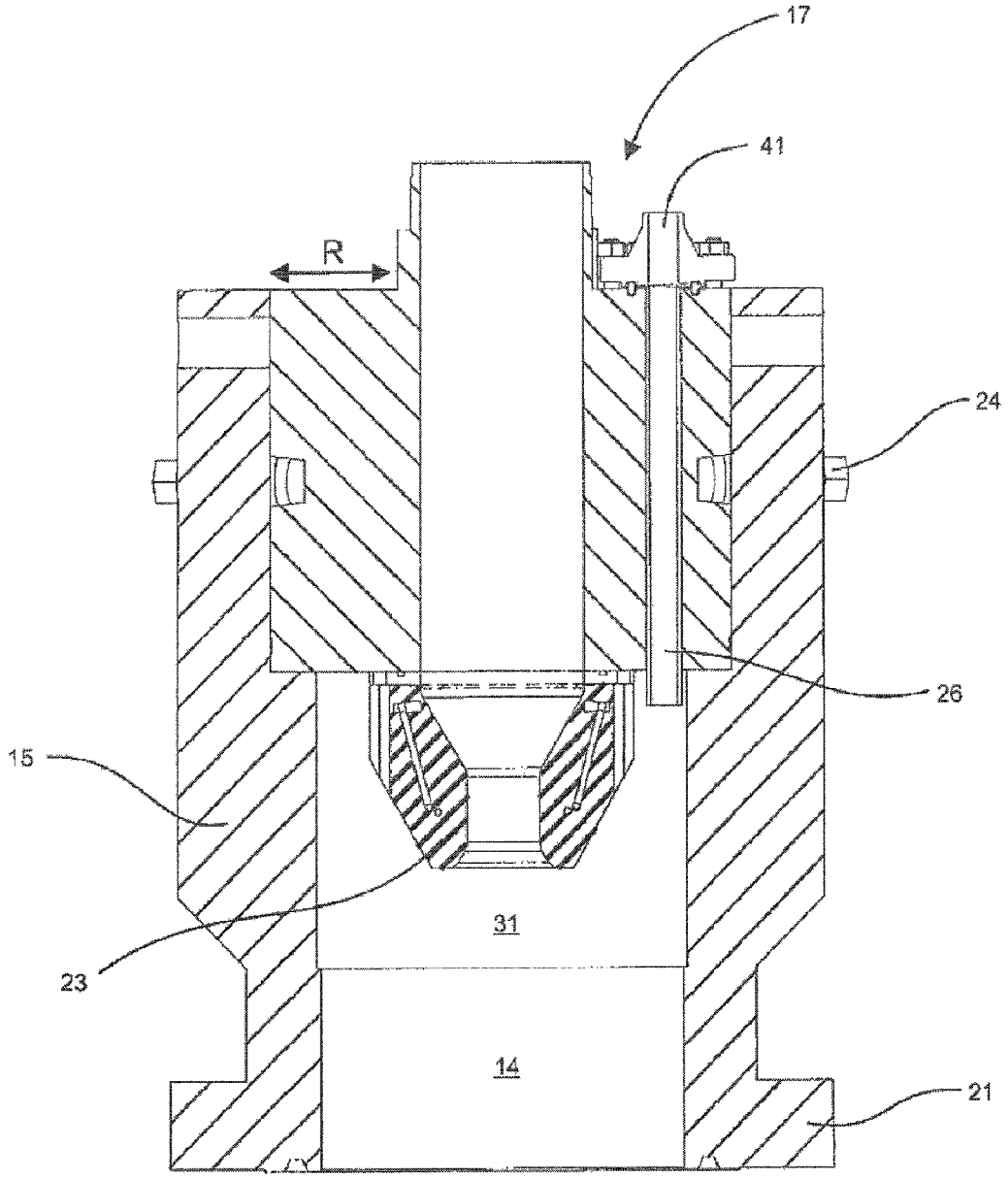
FIG. 10 is a side view of an embodiment of the present invention, illustrating a stationary housing and a sealing assembly with a top entry cable bore for big bore operations.

Referring to FIG. 10, the stationary housing 15 is correspondingly larger, forming a large annular space R about the tubing string 13 and the cylindrical sleeve 36 of the sealing assembly 17. The sealing assembly 17 can have a sufficiently large cross-section to include the cable bore 26 that extends therethrough. There is no longer a need to encroach on the structure or side wall 34 of the stationary housing 15 for cable displacement. The cable bore 26 is now adjacent but spaced radially outside the usual elastomeric rubber stripper element 23, and thereby avoiding proper sealing of tubulars by the stripper element 23.

In such an embodiment, there is no need for a separate cable bypass sub 12 and the cable access 19 in the side wall 34 of the stationary housing 15. A cable can pass through the cable entry 41 in the sealing assembly 17, emerging downhole of the stripper element 23 in the lower portion 31 of the bore 14 for rigging up to the side entry sub and tubing string extending downhole from the sealing assembly 17. The sealing assembly 17, tubing string and cable 11 can be lowered safely into the large bore stationary housing 15 and the sealing assembly 17 secured therein. The sealing assembly 17 can be similarly secured within the bore 14 by the plurality of lag bolts 24 circumferentially spaced about the stationary housing. The lag bolts 24 can be actuated manually or automatically to engage the sealing assembly 17 for applying a retaining or downward force thereto.

Once the sealing assembly 17 is installed within the bore 14, the cable bore 26 allows passage of the tubing string 13 from above the sealing surface 32 to the lower portion 31 of the bore 14. As the sealing assembly 17 has a cross section sufficient enough to include the cable bore 26, the cable wellbore portion 11W need not encroach the side wall of the stationary housing 15 to bypass the sealing surface 32.

In an alternate embodiment, the cable bore 26 of the "big bore" embodiment can further comprise a high pressure seal for sealing around the cable for isolating the wellbore below the sealing assembly 17 and preventing wellbore fluids from passing through the cable bore 26.

In another embodiment, the cable bore 26 can have a mechanism, such as a debris seal, for preventing solids from entering the cable bore 26 from the wellbore. In another embodiment, the cable bore 26 can also have rollers for aiding in the passing of the cable therethrough.

In another embodiment, the sealing assembly 17 can have cable shear rams to cut the cable 11 in cases of emergency.

In another embodiment, the sealing assembly 17 can also have means to measure a tension of the cable.

In Operation

As shown in flow chart of FIG. 9, in the first block 500, the stationary housing 15 is provided in fluid communication with the wellbore 1. At next block 510, the tubing string 13 is passed through the sealing assembly 17.

While the next step, at block 522, may be performed contemporaneously or even before block 510, the cable 11 is passed through the cable access 19 in the sealing assembly 17 for establishing a cable wellbore portion 11W.

Accordingly, however prepared, at block 530, the sealing assembly 17, the tubing string 13 and cable 11 are inserted into the bore 14 of the stationary housing 15. At block 550, the sealing assembly 17 is fit to the sealing surface 32 and at block 560 is sealed thereto for isolating the wellbore 1 below the sealing assembly 17. In this embodiment, the sealing to the sealing assembly can be simply through engagement of the sealing assembly 17 to the sealing surface 32. The sealing assembly 17 is secured to the stationary housing 15, such as through lag bolts 24.

Typically, during TLC operations, the drill string does not rotate, and thus the sealing assembly 17 need not have bearings for rotation. However, in an alternate embodiment, the sealing assembly 17 can be a modular lubricated bearing pack as disclosed in either Applicant's U.S. Published Patent Application US2009/01619971 (published Jun. 25, 2009) or in Applicant's PCT Application PCT/CA2009/000835 (filed on Jun. 29, 2009), the contents therein being incorporated fully herein by reference. In such an embodiment, the sealing assembly 17, having the bearing pack, can also be used for wellbore operations that require rotation of the drill string. Using a single sealing assembly (with a bearing pack) for operations requiring the rotation of a drill string and for operations that do not require rotation can reduce the overall costs associated with capital equipment.

The invention claimed is:

1. A system for running a tubing system string downhole in a wellbore and a cable adjacent the tubing string in the wellbore comprising:

a stationary housing having a bore with an upper portion, a lower portion in fluid communication with the wellbore, a sealing surface therebetween and a cable access extending from the upper portion of the bore above the sealing surface to the lower portion of the bore; and a cable bypass sub fit into the cable access, the cable bypass sub having a cable bore and a reconstituting seal wherein the cable passes through the cable bore and bypasses the upper portion of the bore of the stationary housing and further wherein the reconstituting seal engages the sealing surface.

2. The system of claim 1 wherein the cable bypass sub further comprises a sealing ram engaging the reconstituting seal.

3. The system of claim 1 wherein the cable bypass sub further comprises a cable shear ram.

4. The system of claim 1 wherein the cable bypass sub further comprises a cable seal sealing around the cable wherein the wellbore below the sealing assembly is isolated.

5. The system of claim 1 wherein the cable bore is laterally displaced away from the bore of the stationary housing.

6. A method comprising:

providing a stationary housing having a bore, an upper portion, a lower portion in fluid communication with a wellbore, a sealing surface between the upper portion and the lower portion, and a cable access formed in a sidewall of the stationary housing, wherein the cable access extends from the upper portion to the lower portion and exits to the bore below the sealing surface;

passing a tubing string through a sealing assembly;

passing a cable through the cable access for establishing a wellbore portion of the cable for running into the wellbore;

inserting the tubing string, sealing assembly and the wellbore portion of the cable into the bore of the stationary housing;

fitting the sealing assembly to the sealing surface of the stationary housing;

fitting a cable bypass sub to the cable access and passing the cable through the cable bypass sub;

sealingly engaging the sealing assembly with the sealing surface of the stationary housing to isolate the wellbore below the sealing assembly; and wherein sealingly engaging the sealing assembly with the sealing surface of the stationary housing further comprises actuating a sealing ram to engage a reconstituting seal subsequent to the lowering the sealing assembly into the bore of the stationary housing, wherein the cable bypass sub comprises the reconstituting seal.

7. The method of claim 6 further comprising securing the sealing assembly within the upper portion with a plurality of lag bolts circumferentially spaced about the stationary housing extending radially into the bore to engage the sealing assembly.

* * * * *